United States Patent [19]

Bell et al.

[11] 4,398,468

[45] Aug. 16, 1983

[54] RAILWAY PROPULSION SYSTEM SUSPENSION

[75] Inventors: John D. Bell, Royal Oak, Mich.; Michael A. O'Truk, St. Peters, Mo.

[73] Assignee: Rockwell International Corporation, Pittsburgh, Pa.

[21] Appl. No.: 159,789

[22] Filed: Jun. 16, 1980

[51] Int. Cl.[3] ..... B61C 3/00; B61D 9/50; B61D 3/04

[52] U.S. Cl. ..... 105/136; 105/135; 105/182 R

[58] Field of Search ..... 105/133, 135, 136, 182 R, 105/193

[56] References Cited

U.S. PATENT DOCUMENTS

| | | | |
|---|---|---|---|
| 1,813,140 | 7/1931 | Bethel | 105/136 X |
| 2,084,891 | 6/1937 | Cease | 105/136 |
| 3,313,245 | 4/1967 | Sundby | 105/193 X |
| 3,468,389 | 9/1969 | Nelson | 105/136 X |
| 3,646,893 | 3/1972 | Sundby | 105/193 X |
| 3,858,525 | 1/1975 | Butine et al. | 105/136 |
| 4,228,739 | 10/1980 | Fitzgibbon | 105/136 |

*Primary Examiner*—Bruce H. Stoner, Jr.
*Assistant Examiner*—Howard Beltran

[57] ABSTRACT

A propulsion system suspension is provided for a railway truck of the type which includes a pair of wheels associated with the propulsion system which are secured to the ends of an axle which is mounted to extend transversely between the ends of first and second side frames of the truck. The propulsion system suspension includes a gear box having an output end supported by the axle extending therethrough and an input end which is resiliently supported by a strut from the first side frame. A motor has a rear end which is resiliently secured to the second side frame as the motor extends transversely toward the first side frame. A universal coupling device is provided between the input end of the gear box and a front end of the motor.

11 Claims, 9 Drawing Figures

RAILWAY PROPULSION SYSTEM SUSPENSION

BACKGROUND OF THE INVENTION

This invention relates to a propulsion system suspension for a railway truck and, more specifically, to such a suspension system which includes means for universally coupling the gear box and the traction motor of the propulsion system thereof.

Modern railway transit cars must be comfortable, durable and reliable for the safety and convenience of the passengers travelling thereon. A number of railway trucks such as those disclosed in U.S. Pat. Nos. 3,313,245 and 3,646,893 include means for allowing some independent side frame action which does contribute significantly to a smooth and comfortable ride. However, the relative movement of the side frames does complicate propulsion system suspension.

One type of propulsion system, which has heretofore been used in railway trucks utilizes a traction motor which is generally mounted to be parallel with the axle. One conventional configuration having this parallel drive arrangement includes a gear box through which drive is imparted to the axle by the electric traction motor which was rigidly mounted to the gear box. Since the traction motor and the gear box unit form a rigid assembly, the entire assembly is resiliently mounted to the axle and the truck side frames. The output means of the gear box includes a main gear drivingly secured to a quill shaft which is fitted about the truck axle and utilizes a resilient means for the actual connection with the truck axle. The torque reaction of the driven axle is taken by a vertical linkage or torque arm connected resiliently between the gear box-motor configuration and the truck frame. Such prior arrangements had the advantage of a compact drive assembly but introduced some structural and maintenance problems. The resilient connection between the gear box-motor configuration and the truck frame has to be sufficiently strong to support the weight of both and generally has to be limited to only one of the side frames when the truck is designed to allow a significant amount of relative movement between the side frames. Additionally, should problems develop with the resilient coupling between the gear box and the truck axle which require its replacement, repairs would be quite difficult since a complete disassembly of the axle and wheels would be required.

U.S. Pat. No. 3,468,389 discloses a propulsion system configuration which was intended to eliminate some of these problems. In this configuration, the output gear of the gear box is rigidly secured to the truck axle while its input end is resiliently coupled to one of the side frames. The traction motor includes a rear end which is resiliently secured to the other side frame and extends transversely to be joined to the input end of the gear box. However, rather than being solidly coupled to the input end of the gear box, the front end of the traction motor is resiliently coupled thereto. This configuration does eliminate the need for supporting the entire gear box-motor configuration from one side of the frame and for including a resilient coupling at the axle. It neverless relies on another resilient coupling means, one which is between the motor and the gear box and is subject to failure. Further, resiliently coupling the motor to the input end of the gear box requires that the actual coupling of the motor shaft and the gear box input shaft must also be resilient.

SUMMARY OF THE INVENTION

It is therefore an object of this invention to provide a propulsion system suspension which is durable and reliable and eliminates the need for any resilient coupling in the transmission of the driving torque from the traction motor to the truck axle.

It is another object of the invention to provide the propulsion system suspension as described which is safe and includes backup support means for the traction motor and gear box should the normal support and/or coupling means fail.

These and other objects of the invention can be found in a preferred embodiment thereof which includes a propulsion system suspension for a railway truck of the type which includes a pair of wheels associated with the propulsion system which are secured to the ends of an axle which is mounted to extend transversely between the ends of first and second side frames of the truck. A gear box has an output end which is supported by the axle extending therethrough and means for resiliently securing the input end of the gear box to the first side frame. The motor includes means for resiliently securing the rear end thereof to the second side frame as the motor extends transversely toward the first side frame. A means is provided for universally coupling the input end of the gear box to the front end of the motor.

DESCRIPTION OF THE PREFERRED EMBODIMENT

Figure 1:
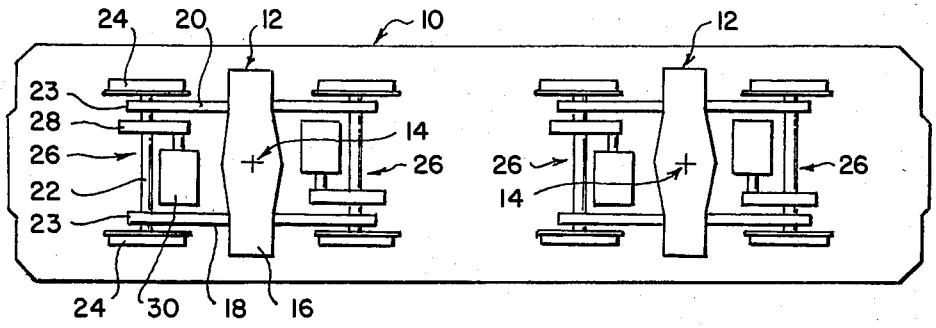
FIG. 1 includes a schematic view of a typical railway transit car having a pair of railway trucks which utilize the propulsion system of the present invention.

As shown in schematic form in FIG. 1, a typical railway transit car 10 is supported on two railway trucks 12 which are pivotally mounted at 14 to the undercarriage of the car 10. Each truck 12 includes a transverse bolster 16 and a pair of side frames 18, 20. At the ends of each truck 12, an axle 22 is resiliently mounted in bearing assemblies 23 which are at the ends of the side frames 18, 20. A railway wheel 24 is secured at each end of the axle 22.

Propulsion for each railway transit car 10 is provided by a propulsion system 26 associated with each axle 22. The propulsion system 26 includes a gear box 28 which is mounted on the axle 22 and an electric traction motor 30 which is parallel with and provides power to the axle 22.

Figure 2:
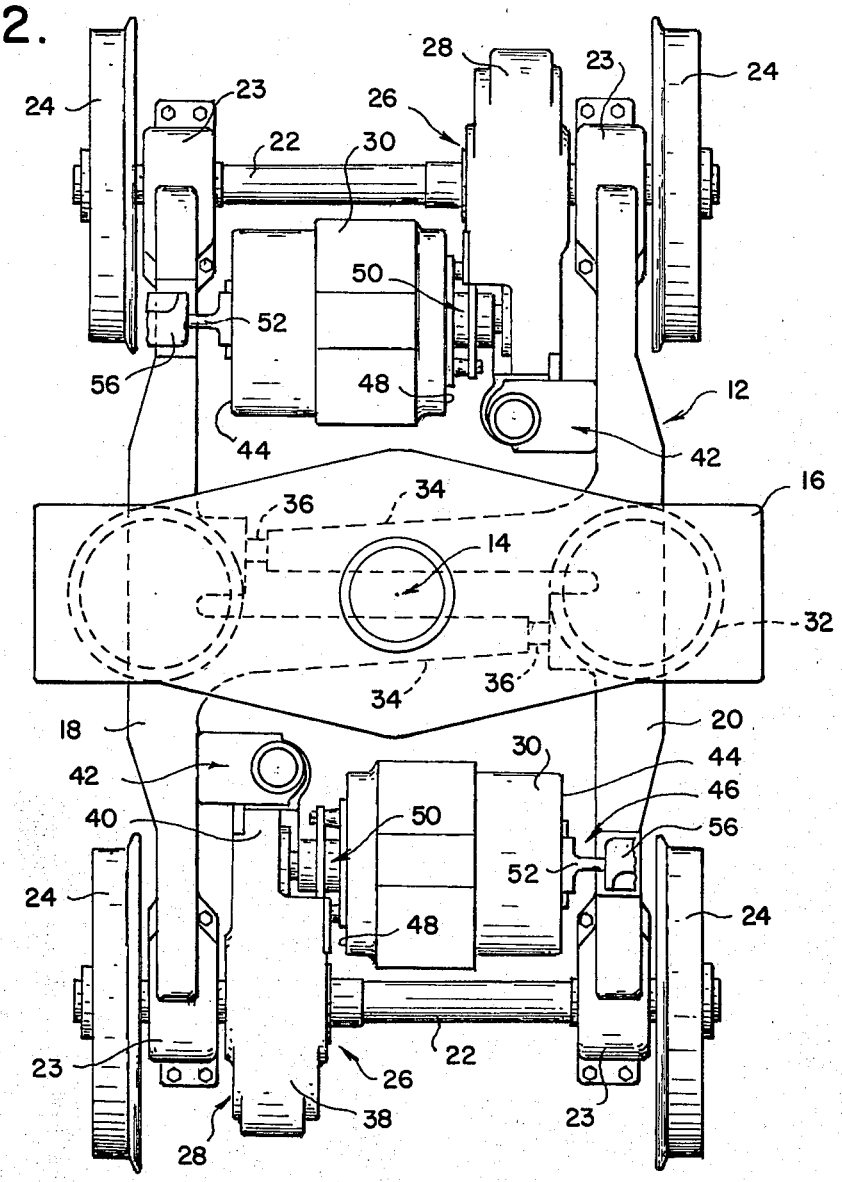
FIG. 2 is a plane view of one of the trucks including a preferred embodiment of the present invention.

As seen in FIG. 2, the bolster 16 of each truck 12 is basically supported on each side frame 18, 20 by a tubular bellows 32 which acts as a pneumatic cushion for the car 10. Since the side frames 18, 20 are not rigidly secured to the bolster 16, there may be included means for relative movement of the side frames 18, 20 which would allow better alignment of the wheels with the track during operation of the car 10. The only direct coupling of the side frames 18, 20 is provided through laterally extending transoms 34 which rigidly extend from each side frame 18, 20 to be received within a spherical bearing assembly 36 at the other side frame 18, 20. It should be noted that in the view of the truck 12 in FIG. 2 and in various views shown in other figures, a number of elements normally present in an operating railway truck have been omitted as unessential to a full understanding of the present invention. For example, there would normally be included an entire system for controlling the load leveling feature of the tubular bellows 32 mentioned hereinabove. Additionally, it is common to use a number of bumper and stop assemblies limiting extreme movement of the side frames and various shock absorbers which would improve ride characteristics. Other hardware such as the motor controls, brakes and various power takeoffs have also been omitted since they do not actually contribute to an understanding of the present invention.

However, the view shown in FIG. 2 does show the major elements of the propulsion system 26 and provides sufficient information for a general understanding of how they are supported within the truck 12. It can be seen that the gear box 28 includes an output end 38 which is supported by the axle 22 which extends therethrough. An input end 40 of the gear box 28 is resiliently supported by the side frame 18 at a support strut 42 extending therefrom. The motor 30 includes a rear end 44 which is resiliently secured at 46 to the other side frame 20. A front end 48 of the motor 30 is universally coupled at 50 to the input end 40 of the gear box 28.

Figure 3:
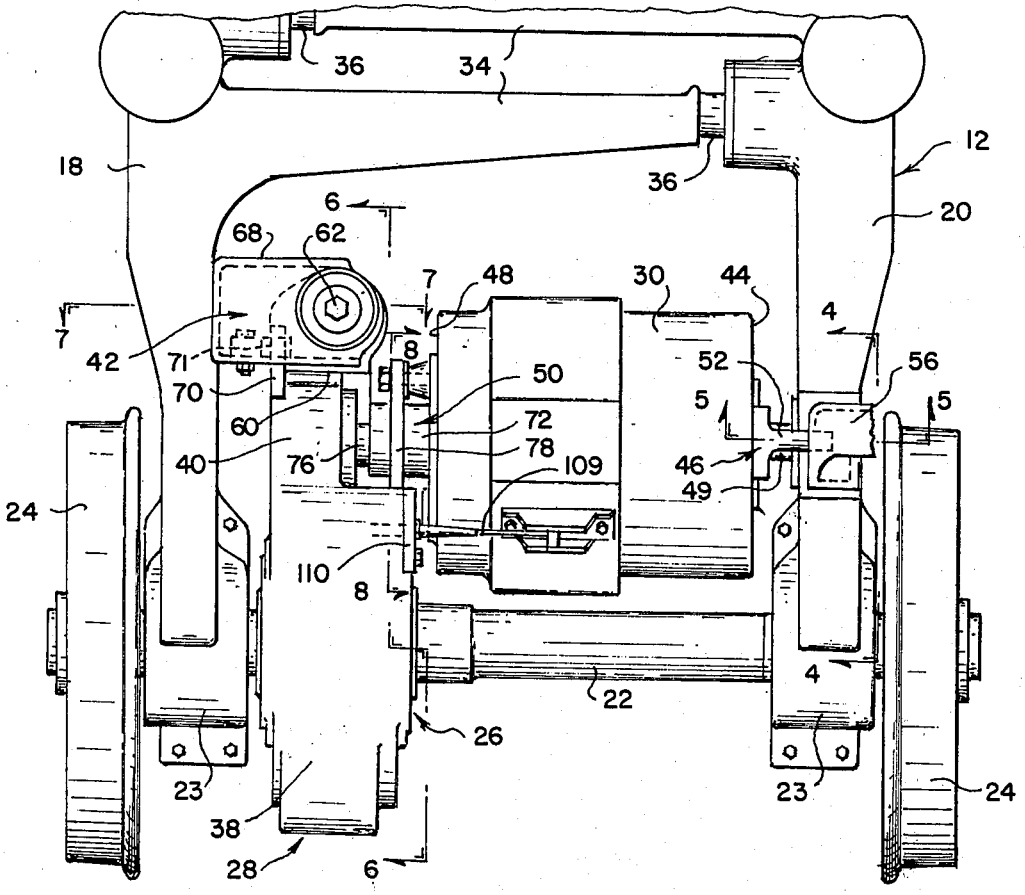
FIG. 3 is a partial, enlarged view of the truck as shown in FIG. 2 including details of the propulsion system as it relates to one of the truck axles.

For a better understanding of the structure of these elements and the suspension provided by the present invention, reference should be made to the single propulsion system 26 as shown in FIG. 3. Although the universal coupling at 50 between the motor 30 and the gear box 28 includes a primary feature of the present invention, a full understanding of the basic resilient support structure provided elsewhere for the various elements of the propulsion system would be helpful. Additionally, it is appropriate to explain a number of safety features built into the propulsion system suspension which are intended to insure that the elements of the propulsion system are safely restrained relative to the truck 12 should there be a failure to one of the normal support devices.

Figure 4:
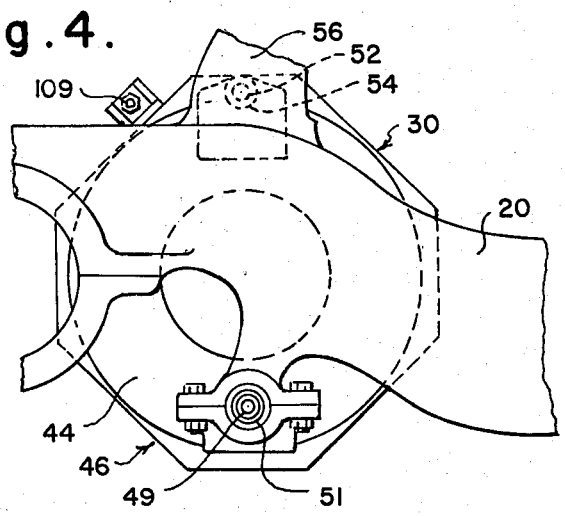
FIG. 4 is a view of the preferred motor support as seen along line 4—4 of FIG. 3.
Figure 5:
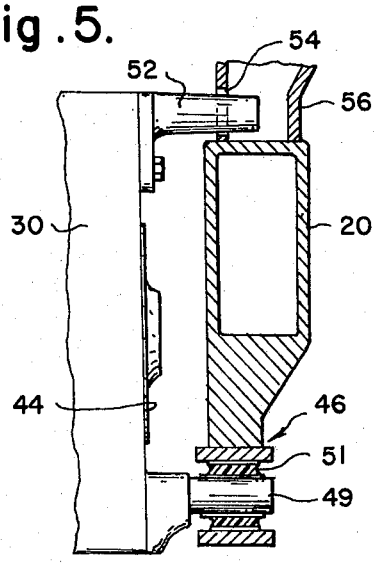
FIG. 5 is a view as seen along line 5—5 of FIG. 3.

As seen in FIGS. 4 and 5, the resilient support at 46 for the rear end 44 of the motor 30 includes a support pin 49 which extends axially from the rear end 44. The pin 49 is received within a rubber bushing 51 which is rigidly supported by the side frame 20. The rubber bushing 51 is designed to include a high radial stiffness as compared to its axial stiffness to allow more freedom of movement relative to the side frame 20 in an axial direction than in a radial direction. Accordingly, as the side frame 20 moves relative to the side frame 18, the rear end 44 of the motor 30 will tend to follow the motion of the side frame 20. The resilient support 46 allows limited angular deviations and some axial movement as the linear distance between the side frame 18, 20 at the motor 30 changes.

However, should there be a failure of the overall support provided at 46, there is also included means in the propulsion system suspension of the present invention which will insure that the rear end 44 of the motor 30 is generally restrained and supported by the side frame 20. A safety pin 52 extends axially from the rear end 44 for this purpose and is freely received within an aligned, encircling hole 54 in a structural portion 56 of the side frame 20. During normal operation, there would be no contact between the pin 52 and the edges of the hole 54. Radial contact would occur for support of the rear end 44 of the motor 30 only if there is a failure of the normal resilient support which is provided at 46.

Figure 6:
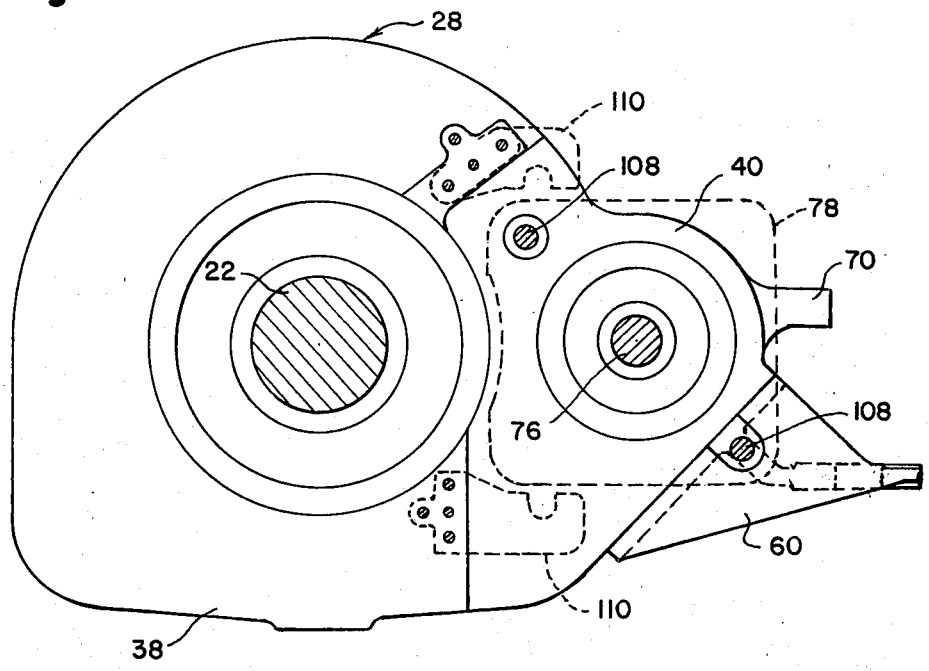
FIG. 6 is a side elevational view of the gear box as seen along line 6—6 of FIG. 3.
Figure 7:
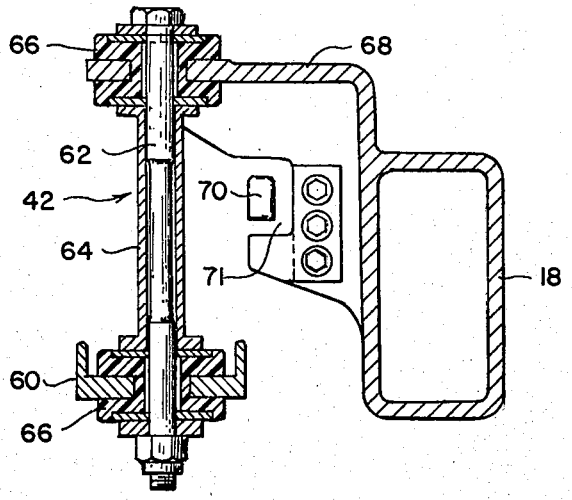
FIG. 7 is an elevated, sectional view of the support for the input end of the gear box as seen along line 7—7 of FIG. 3.

As seen in FIG. 6, the output end 38 of the gear box 38 is supported by the axle 22 extending therethrough. The support for the input end 40 includes a support arm 60 which extends from the input end 40. As seen in FIG. 7, the support arm 60 is resiliently secured to the side frame 18 through the strut 42. The strut 42 includes an interior rod 62 which extends through a spacer element 64 to be supported at each end by a rubber bushing member 66. The bushing members 66 are installed in holes in the support arm 60 and an extended portion 68 of the side frame 18. As thus described, the strut 42 resiliently supports the weight of the input end 40 of the gear box 28 and maintains the gear box 28 in proper position as reactive thurst forces act upon the gear box 28 during car operation. The bushing members 66 allow some limited movement in all directions relative to the side frame 18.

As in the case of the motor 30, the preferred suspension for the propulsion system 26 includes safety means for insuring the support of the input end 40 of the gear box 28 should the normal support means fail. As seen in FIGS. 6 and 7, a safety lug 70 also extends outwardly from the input end 40 to be located within an opening 71 which is provided in the extended portion 68 of the side frame 18. During normal operation no contact will be made between the walls of the opening 71 and the safety lug 70 but backup support will be provided should there by any failure of the strut 42.

Figure 8:
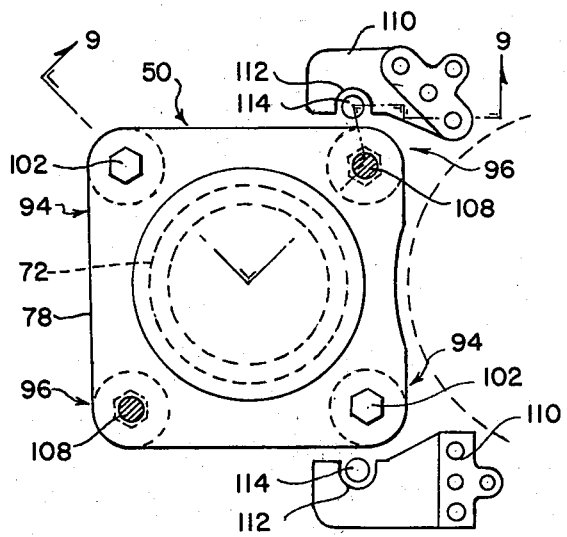
FIG. 8 is an elevational view of the preferred universal coupling of the present invention as seen along line 8—8 of FIG. 3.
Figure 9:
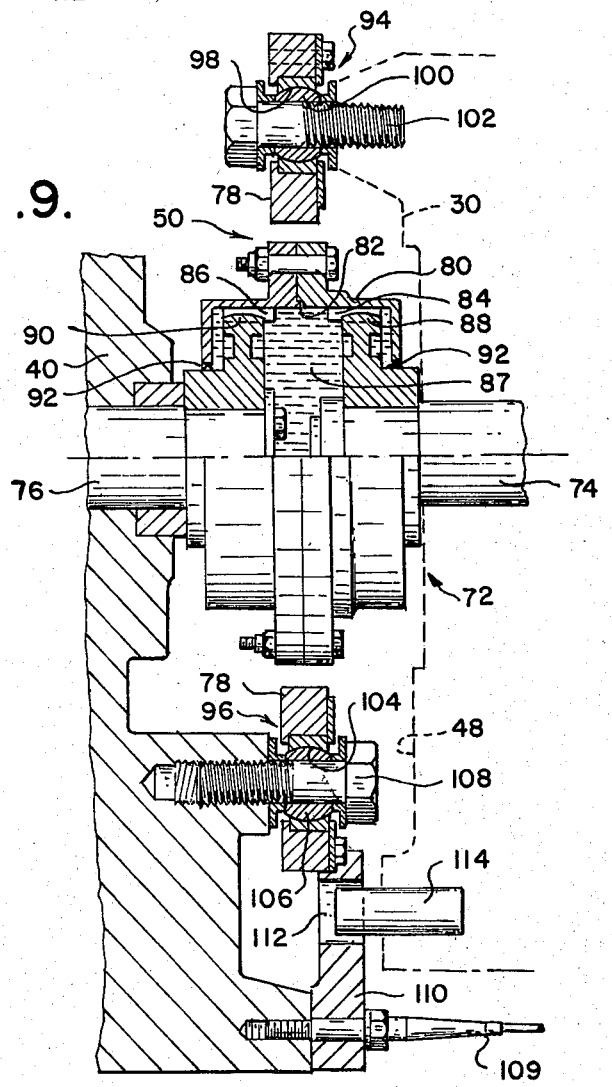
FIG. 9 is an enlarged fragmentary view of the preferred universal coupling of the present invention as generally seen along line 9—9 of FIG. 8.

As seen in FIGS. 8 and 9, the universal coupling at 50 primarily includes a coupling assembly 72 between the output shaft 74 of the motor 30 and the input shaft 76 of the gear box 28 and an adapter plate 78. The preferred coupling assembly 72 is designed to directly transmit torsional forces between the output shaft 74 and the input shaft 76. This is accomplished by the use of a coupling housing 80 which includes a generally cylindrical interior surface 82 which includes two arrays of inwardly extending, axially aligned teeth 84, 86. Although in the preferred embodiment each array 84, 86 is identical and is generally located in only one-half of an interior 87 of the housing 80, it can be seen that one array of axially longer teeth might have been utilized. Additionally, it would be possible for the arrays 84, 86 to be provided different number of teeth, pitch etc. should this be considered desirable. Each of the output shaft 74 and input shaft 76 includes radially extending teeth 88, 90 which are respectively aligned with and in engaging contact with the array of teeth 84, 86. The teeth 88, 90 are each provided a spherical outer surface which does not interfere with the direct transmission of torsion forces between the shafts 74, 76 but does allow limited angular misalignment of the shafts 74, 76 which is consistent with the universal coupling feature of the present invention.

The housing 80 extends about the ends of the shafts 74, 76 to define the interior 87 thereof which includes the array of teeth 84, 86 and the radially extending teeth 88, 90. A gasket is provided at each end of the housing 80 at 92 to make resilient sealing contact with each shaft 74, 76 to allow the interior 87 to be filled with a lubricating fluid for smooth, efficient shaft operation.

Although the coupling assembly 72 basically secures the shafts 74, 76 to each other, it is not designed to support the weights of the motor 30 and the input end 40 of the gear box 28 during normal car operation. To properly secure the front end 48 of the motor 30 to the input end 40 of the gear box 28 the above mentioned adapter plate 78 is provided. The adapter plate 78 encircles the coupling assembly 72 to insure that it does not interfere with the operation of the coupling assembly 72. In the preferred adapter plate configuration, the plate 78 is secured to the front end 48 of the motor 30 by ball and socket mountings 94 at a pair of diametrically opposed first locations thereon. The input end 40 of the gear box 28 is also secured to the adapter plate 78 by a pair of ball and socket assemblies 96 at a pair of diametrically opposed second locations thereon. Since each of the first locations are in equal distance from each of the second locations, the adapter plate 78 provides a universal coupling between the front end 48 and the input end 40.

Specifically, each ball and socket assembly 94 includes a self-lubricating spherical ball bushing 98 at each of the first locations in the adapter plate 78. A spherical bearing member 100 is supported by a bolt 102 which is rigidly secured to the front end 48 as the bearing member 100 is received within the bushing 98. Similarly, each ball and socket assembly 96 includes a self-lubricating spherical ball bushing 104 which retains a spherical bearing member 106 rigidly secured to the input end 40 of the gear box 28 by a bolt 108.

As thus described, the universal coupling at 50 securely joins the front end 48 of the motor 30 to the input end 40 of the gear box 28 to basically support the weight of the front end of the motor 30 and to resist any reactive torsional forces which might tend to separate them. It can be seen that a slight misalignment of the shafts 74, 76 resulting from the motor 30 and gear box 28 being resiliently mounted to the relatively movable side frames 18, 20 will not interfere with the direct transmission of torsional forces between the shafts 74, 76.

However, as in the case of the other suspension support devices mentioned hereinabove, the present invention includes means for insuring against separation of the front end 48 from the input end 40 should the universal coupling at 50 fail during car operation. If one or two of the bolts 102, 108 were to fail, it would be possible for the motor 30, as thus described, to move axially away from the input end 40 of the gear box 28. The resilient support at 46 at the near end 44 is intended to allow some axial movement and could not be expected to prevent extensive, undesired movement in this direction. Therefore, the suspension system includes for safety purposes a restraining cable 109 which is secured to the gear box 28 and motor 30 and to limit the axial separation therebetween. The preferred cable 109 is installed with about $\frac{1}{8}$ of an inch stack to limit the axial separation without interfering with normal universal coupling operation. Should there be a complete failure of the universal coupling 50, however, the cable 109 would not prevent the front end 48 of the motor 30 from dropping vertically out of alignment with the input end 40 of the gear box 28.

A preferred safety device for this purpose includes a pair of safety hooks 110 which are rigidly secured to the input end 40 of the gear box 28 adjacent the front end 48 of the motor 30. Each safety hook 110 includes an opening 112 therein which is intended to basically capture a safety stud 114 which extends rigidly from the front end 48 of the motor 30. During normal operation, there would be no contact betwen the safety stud 114 and the interior of the opening 112. However, should there be a failure of the universal coupling at 50, the studs 114 and safety hooks 110 are designed to maintain the front end 48 adjacent the input end 40 of the gear box 28. Although the stud and safety hook configuration as thus described is included in the preferred embodiment of the invention, it should be apparent that any number of overlapping projecting means at the front end of the motor and the input end of the gear box might be utilized for this purpose. It is only essential that they normally remain free of contact and be capable of contact to support the front end of the motor relative to the input end of the gear box should there be failure of the universal coupling therebetween.

From the description of the preferred embodiment of the invention hereinabove, it should be apparent that a number of alternative support and safety means might be provided without departing from the scope of the invention as claimed.

We claim:

1. A propulsion suspension for a railway truck of the type which includes a pair of wheels associated with said propulsion system which are secured to opposite wheel ends of an axle which is mounted to extend transversely between adjacent axle support ends of first and second side frames of said truck, said propulsion system suspension including:

a gear box having an output end supported by said axle extending therethrough and means for resiliently securing an input end thereof to said first side frame;

a motor having means for resiliently securing a rear end thereof to said second side frame as said motor extends transversely toward said first side frame; and means for universally coupling said input end of said gear box to a front end of said motor including a coupling assembly between an output shaft of said motor and an input shaft of said gear box and adaptor plate which encircles said coupling assembly; said adaptor plate being secured to said front end of said motor by ball and socket means at a pair of diametrically opposed first locations thereon and to said input end of said gear box by ball and socket means at a pair of diametrically opposed second locations thereon; and each of said first locations being an equal distance from each of said second locations.

2. The propulsion system suspension as set forth in claim 1, where said ball and socket means includes a self-lubricating spherical ball bushing at each of said first locations having a spherical bearing member installed therein which is rigidly secured to said front end of said motor and a self-lubricating spherical ball bushing at each of said second locations having spherical bearing member installed therein which is rigidly secured to said input end of said gear box.

3. The propulsion system suspension as set forth in claim 1, wherein said coupling assembly directly transmits torsional forces between said output shaft and said input shaft.

4. The propulsion system suspension as set forth in claim 1, wherein said coupling assembly includes a housing with an interior cylindrical surface having an array of inwardly extending, axially aligned teeth thereon; radially extending teeth means on each of said output shaft and said input shaft being aligned with and in engaging contact with said array of said teeth; and said teeth means having a spherical outer surface to allow limited angular misalignment of said output shaft and said input shaft while directly transmitting torsional forces therebetween.

5. The propulsion system suspension as set forth in claim 4, wherein said housing makes resilient, sealing contact with each of said output shaft and said input shaft to define an interior thereof which includes said array of said teeth and said teeth means and is filled with a lubricating fluid.

6. The propulsion system suspension as set forth in claim 1, wherein said means for resiliently securing said rear end of said motor includes a support pin extending axially from said rear end to be received within a rubber bushing rigidly supported by said second side frame.

7. The propulsion system suspension as set forth in claim 6, wherein said rubber bushing has a high radial stiffness as compared to its axial stiffness to allow more freedom of movement relative to said second side frame in an axial direction than in a radial direction.

8. The propulsion system suspension as set forth in claim 6, further including a safety pin extending axially from said rear end of said motor which is freely received within an aligned, encircling hole in said second side frame, said safety pin being capable of making radial contact with the edges of said hole for support of said rear end of said motor only upon failure of said means for resiliently securing said rear end of said motor.

9. The propulsion system suspension as set forth in claim 1 wherein said means for resiliently securing said input end of said gear box includes a support arm extending therefrom to be secured to a first end of a strut member, said strut member having a second end thereof secured to said first side frame and a rubber element being utilized at at least one of said first and said second ends to provide resilient support for said input end of said gear box.

10. The propulsion system suspension as set forth in claim 9 further including a safety lug extending horizontally from said input end of said gear box to be freely received within an opening in said first side frame, said safety lug being capable of making vertical contact with the walls of said opening for support of said input end of said gear box only upon failure of said means for resiliently securing said input end of said gear box.

11. The propulsion system suspension as set forth in claim 1, further including overlapping projecting means on said front end of said motor and said input end of said gear box, said overlapping projecting means being normally providing a space therebetween as said means for universal coupling supports said forward end of said motor relative to said input end of said gear box and said overlapping projecting means on said front end of said motor and said input end of said gear box being capable of contact therebetween to support said forward end of said motor relative to said input end of said gear box upon any failure of said means for universally coupling said input end of said gear box to said front end of said motor which would prevent said means for universal coupling from providing said support.

* * * * *